United States Patent [19]

Rubik et al.

[11] Patent Number: 4,685,681

[45] Date of Patent: Aug. 11, 1987

[54] COMPOSITE ARRAY APPARATUS AND METHOD

[75] Inventors: Erno Rubik, Budapest, Hungary; Cheung K. Fai, Hong Kong, Hong Kong

[73] Assignee: 501 Rubik Studio, Budapest, Hungary

[21] Appl. No.: 898,468

[22] Filed: Aug. 20, 1986

Related U.S. Application Data

[63] Continuation-in-part of Ser. No. 903,575, Jul. 28, 1986.

[51] Int. Cl.[4] ..... A63F 9/08

[52] U.S. Cl. ..... 273/155; 16/227; 16/366; 29/433; 160/129; 160/135; 160/185; 160/231 A; 272/8 R; 428/12

[58] Field of Search ..... 16/227, 366; 52/645, 52/646; 160/129, 135, 136, 137, 185, 229 R, 231 R, 231 A; 272/8 R, 8 N; 273/153 S, 155; 428/12; 446/109, 119, 487, 490; 29/433

[56] References Cited

U.S. PATENT DOCUMENTS

| | | | |
|---|---|---|---|
| 1,278,701 | 9/1918 | McIntire . | |
| 2,245,875 | 6/1941 | Rutherford . | |
| 3,487,578 | 1/1970 | Sudermann . | |
| 3,596,396 | 8/1971 | Thomson . | |
| 3,628,261 | 12/1971 | Thompson . | |
| 3,751,760 | 8/1973 | Wakeman | 16/227 |
| 4,147,198 | 4/1979 | Ytter | 160/135 |
| 4,183,166 | 1/1980 | Borner . | |
| 4,429,878 | 2/1984 | Asao . | |
| 4,466,799 | 8/1984 | Argiro . | |

OTHER PUBLICATIONS

Games & Puzzles, Sep. 1976, p. 33.

*Primary Examiner*—Anton O. Oechsle
*Attorney, Agent, or Firm*—Edward J. Handler, III; Joseph E. Root, III

[57] ABSTRACT

An array of plate-like elements is retained by endless filaments looped on the elements to form migrating hinges between individual elements and other elements adjoining same. Grooves are formed in the surfaces of each plate, the grooves being in two groups, with the members of each group being mutually parallel, and the grooves of each surface being in overlying registration. The filaments lie within the grooves in a selected pattern, with filaments forming anchor points at plate sides at which the filament wraps around the side of the plate to enter a groove from the other group of grooves on the opposite side of the plate, and hinge points at plate sides where the filament passes from one plate to an abutting plate, proceeding from one surface to the opposite surface in doing so. Manipulation of the resulting array allows two such plates to rotate mutually about an axis defined by hinge points lying on their abutting sides. Further manipulation allows the hinge between such plates to migrate to one of two other sides on such plates.

15 Claims, 40 Drawing Figures

COMPOSITE ARRAY APPARATUS AND METHOD

BACKGROUND OF THE INVENTION

This application is a Continuation-in-Part of U.S. application Ser. No. 903,575, filed July 28, 1986, claiming priority under 35 U.S.C. 119 from Hungarian Patent Application No. 1211/1985, filed Mar. 29, 1985.

This invention is directed to the field of composite arrays of individual elements, and more particularly to the field of composite arrays able to form a variety of different shapes upon manipulation of individual elements.

It has long been known to employ arrays of elements to form objects employed for entertainment, such as toys, puzzles and the like. A particular embodiment of such devices is the "Jacob's Ladder", a toy made up of generally rectangular plates or blocks, pairs of blocks being joined by tapes affixed to their surfaces to form an array, with the blocks aligned end to end. The joining points are so arranged that if the array is held vertical and an upper element is allowed to rotate downward about its lower side, each block in turn similarly rotates downward, reversing the flat surface exposed to the viewer. The result provides an entertaining effect. Typical of the patents employing such devices is U.S. Pat. No. 1,278,701, issued to McIntyre in 1918. Over the years, improved assembly and manufacturing techniques have been proposed, without altering the basic "Jacob's Ladder" design, as in U.S. Pat. No. 4,183,166, to Borner.

All known approaches to such arrays share the fundamental feature that pairs of elements are permanently linked. The linking arrangement can become complex, as seen in the device shown by Rutherford in U.S. Pat. No. 2,245,875, in which complexity is achieved by forming elements in a variety of shapes and linking some elements with tapes forming an angle with other tapes. The principle remains, however, that the array is formed as an open-ended chain, with pairs of blocks permanently linked.

A step forward from the original "Jacob's Ladder" device can be seen in the 1970 disclosure of U.S. Pat. No. 3,487,578, to Sudermann. Here, the basic array is two-dimensional, with joining tapes being attached to more than two blocks. Notwithstanding the ability of this device to assume a wider variety of forms than the conventional "Jacob's Ladder", however, several points are important to an understanding of this invention. First, individual blocks remain permanently attached to certain other blocks in the array. Although a given set of joining tapes extends across several other blocks, the tapes are affixed to each block, so that blocks will always be attached to the same other blocks at the same points, in fixed relation, no matter how the device is manipulated. Second, this device requires that the blocks be cubic, rather than the variety of shapes that could be used in a "Jacob's Ladder". The "double-acting" hinge that lies at the heart of this patent only operates if all sides of the elements are identically dimensioned—inherently calling for cuboid blocks. Finally, each joined pair of blocks has a limited range of relative motion, stemming from the fact that the adjacent blocks are permanently attached by the tapes. Thus, a given oined pair of elements is limited to one of three relationships.

Other devices employing cubic blocks have abounded in the art, all sharing the requirement of permanent joints between individual elements. For example, Thompson, in U.S. Pat. No. 3,628,261, presents an "Educational Toy Device" that uses hinge joints at the corners of blocks in a stated pattern to form a device that illustrates mathematical relationships. Argiro, in U.S. Pat. No. 4,466,799, offers a similar toy, in which the blocks are joined by flexible cords carried in passages formed through the blocks, indicia being provided on the blocks to teach multiplication tables. Also, U.S. Pat. No. 3,596,396, to Thomson, illustrates a refinement of these ideas, with a chain of blocks joined by permanent hinges arranged so that the axis of rotation of some hinges is displaced from the axis of other hinges by 90 degrees, permitting the resulting open-ended array to form different shapes, and in particular, shapes replicating that of the individual elements. To some extent, of course, this design represents a retrogression from previous work, in that a permanently-joined pair of elements is limited to two relationships by the nature of the hinge joining them.

The limitations common to all prior art efforts in this field can be seen easily. All of the devices discussed above can start from a given array orientation (for example, the flat rectangular array of Sudermann or the chain of Thomson), can be manipulated to form various shapes, and can be further manipulated to return to their original shapes. When that happens, however, the relationship between individual elements is exactly the same as the relationship seen when the operation was started. That fact flows directly from the fact that individual elements are permanently joined, and only one relationship is possible in the basic shape of the array. That is, if the Sudermann device is laid out in a flat rectangle, the same element will always lie at the upper left corner, for example. Similarly, the end pieces in Thomson's chain will always be the same two blocks.

A different line of development has employed flat, scored elements, typically made of cardboard or the like, to form a foldable game or puzzle. Asao, U.S. Pat. No. 4,429,378, is a recent example of such disclosures, employing strips of cardboard or paper, scored for folding at certain points to produce entertaining results when the strips are folded and overlapped at certain positions.

In terms of fundamental design, however, the art has remained limited by the thrust of the common wisdom, that individual elements must be permanently joined to achieve a workable device. The present invention goes beyond that limitation to achieve radically new and totally different results.

SUMMARY OF THE INVENTION

It is an object of the invention to provide a composite array in which individual elements can assume a variety of positions with respect to other array elements.

Another object of the invention is a composite array in which individual elements do not occupy fixed positions relative to other elements.

A yet further object of the invention is a method for assembling an array of individual elements with retaining means, such that two elements so joined do not occupy fixed positions relative to one another, but can be manipulated into a variety of positions.

BRIEF DESCRIPTION OF THE DRAWINGS

FIG. 1(*b*) is a pictorial representation of the construction of a single plate of the present invention;

FIG. 2(*b*) is a plan view of an alternative embodiment of the invention;

FIG. 2(*c*) is a cross-section of a portion of the element of FIG. 1, taken on the plane II—II of FIG. 1(*a*);

FIG. 4(*b*) is a detail side view of the area IV(*b*) of FIG. 3(*a*);

DETAILED DESCRIPTION OF PREFERRED EMBODIMENTS

Figure 1A:
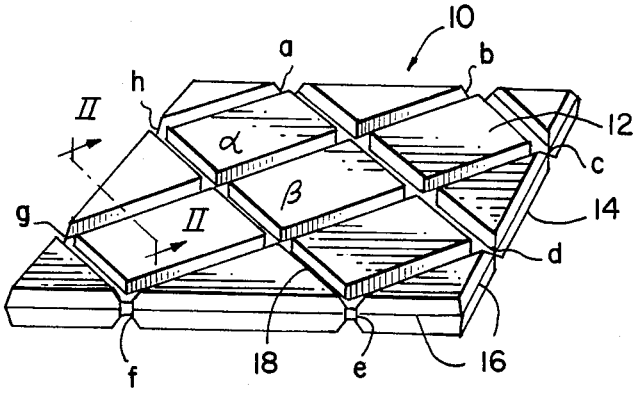
FIG. 1(*a*) is a pictorial representation of an embodiment of a single element of the invention.
Figure 1B:
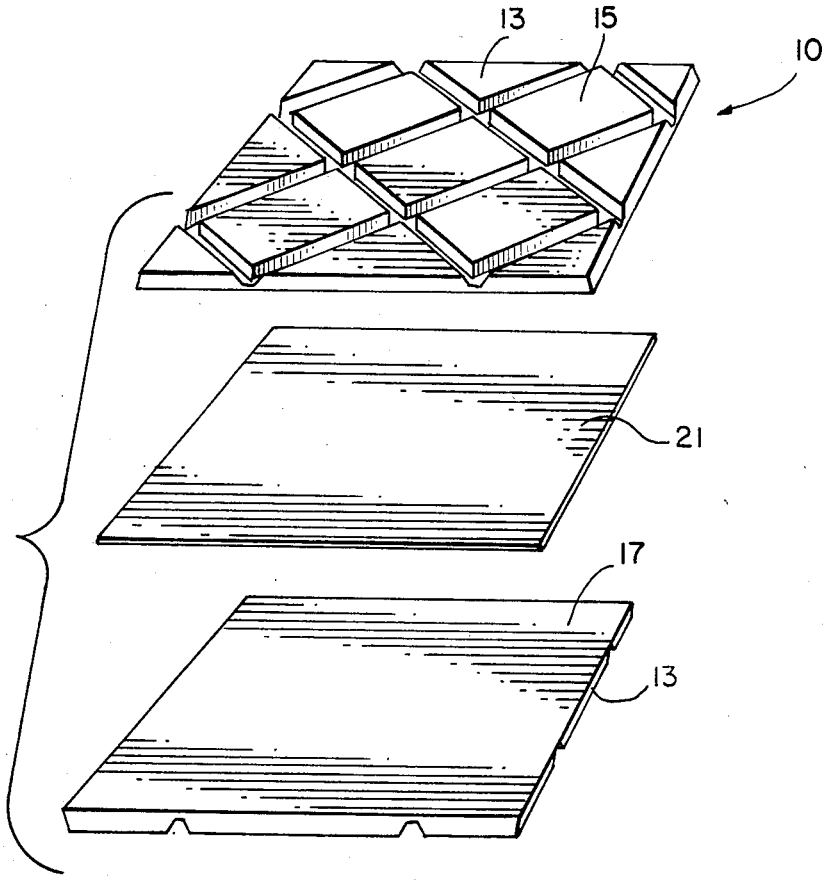

A basic element of the present invention is plate 10, shown in FIG. 1(*a*). Preferably, the plate takes the form shown, that of a flat square, having a top surface 12, a bottom surface 14, and four sides 16. As will be seen, a plate changes orientation during operation of the invention, and thus the terms "top" and "bottom" are adopted hereinafter purely for purpose of convenient reference. Plate shapes other than the square plate of FIG. 1(*a*) will be discussed hereafter. Typical dimensions for plates of the depicted embodiment may be about 55 mm. square and about 5 mm. thickness.

A series of straight grooves 18 is formed on the top and bottom surfaces of the plate. The cross-section of FIG. 2(*c*) shows a preferred shape of a groove, with a retaining section 20 having vertical walls at the bottom of the groove, and sloping sections 22 angled toward the plate surface. Points where a groove intersects a plate side are labelled a through h in FIG. 1(*a*), starting from the upper left corner of the depicted plate and proceeding clockwise. Hereinafter, both sides and grooves will be referred to by reference to points lying on a plate side or at the two ends of a groove, e.g., groove g–f, or side a–b.

Figure 2A:
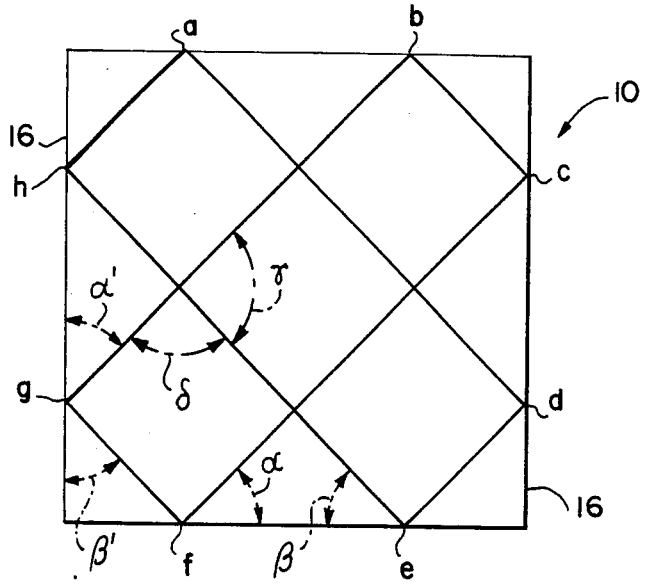
FIG. 2(*a*) is a plan view of a preferred embodiment of th invention.
Figure 2B:
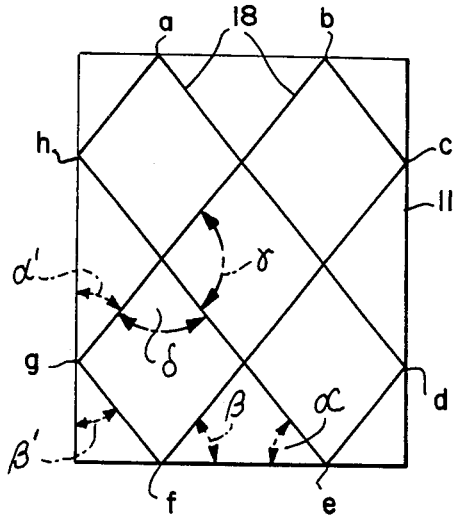
Figure 2C:
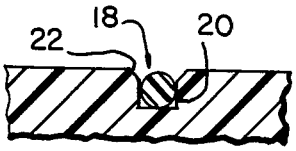

The series of grooves is made up of two distinct sets of grooves, and within each set, grooves are mutually parallel. Thus, a first set of grooves includes grooves b–c, a–d, h–e, and g–f, and a second set includes a–h, b–g, c–f, and d–e. Grooves intersect sides 16 to enclose angles alpha and beta and mutually intersect to enclose angles gamma and delta, as best seen in FIG. 2(*a*). In the preferred plate of FIGS. 1(*a*) and 2(*a*), both gamma and delta are 90 degrees, and the intersections are spaced equidistantly, so that four mutally connected intersections define a square.

It also is important to understand the relationship between the angles alpha and beta at which the grooves intersect the sides 16. These angles will always be equal, no matter what the values of angles gamma and delta. This point is clearly seen in the rectangular alternate plate embodiment of FIG. 2(*b*), in which sides a–b and e–f are shorter than sides c–d and g–h. There, angle gamma is larger than angle delta, but angles alpha and beta remain equal. Also, it can be noted that the angles at which the grooves intersect long sides c–d and g–h, alpha prime and beta prime, differ from angles alpha and beta. Geometrically, it can be seen that the sum of these angles is 90 degrees. Although a lower limit of about 25 degrees exists for the angle at which a groove intersects a side, one can choose the configuration of grooves to suit other functional or aesthetic criteria. The primary constraint in choosing a groove layout is that the angles alpha and beta be equal.

Two points should be noted: First, the series of grooves formed on the top surface is identical to that formed on the bottom, so that a groove on one surface directly overlies a similar groove on the other surface. Hereinafter, the two grooves extending between the same pair of points will be distinguished as "top" or "bottom" grooves. Second, the points at which grooves intersect plate sides are also intersections between grooves. Thus, point a on side a–b lies at the intersection of grooves a–h and a–d.

Although a plate may be formed from any of a variety of materials, it is preferred to mold plates from a hard, durable plastic material such as polystyrene or the like. Plates may be molded as single pieces, but it has been found useful to mold plates in half sections 13, as shown in FIG. 1(*b*). Such sections are taken along a plane parallel to and midway between the top and bottom surfaces 12 and 14, so that each has a grooved outer surface 15 and a flat inner surface 17. If it is desired to employ a graphic design on a plate, it is convenient to form such sections from clear plastic and to sandwich a graphic insert 21 between the plates. The method of retaining plates in an array, discussed hereafter, also retains the plate sections and the graphic insert in mutual overlying relation, so that no additional means for securing the plate sections is required. Hereafter, plates will be discussed as integral units, it being understood that any such discussion of plates includes plates formed in sections.

Figure 3B:
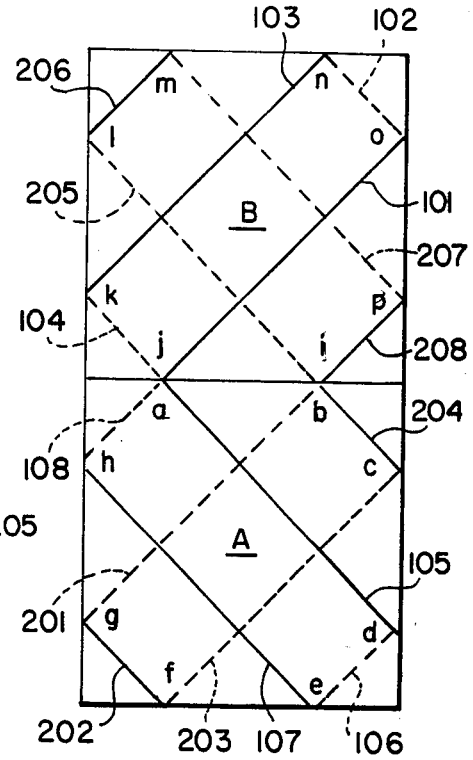
FIGS. 3(*a*) and 3(*b*) are plan views of a two-element embodiment of the invention, showing different orientations of the elements thereof.
Figure 3A:
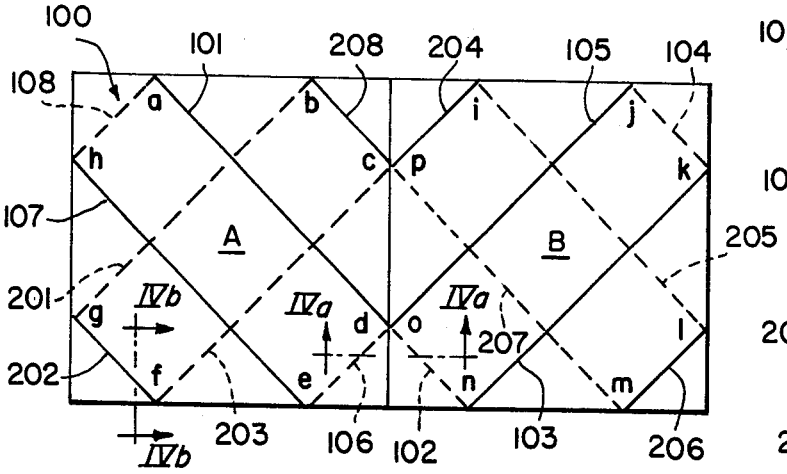

The manner in which the present invention operates to produce a multiplicity of plate arrangements can best be understood by considering the fundamental example, the two-plate array of FIG. 3(*a*). There, plates A and B are linked by two filaments 100 and 200. Each filament lies in surface grooves of each plate, arranged in a pattern discussed below. Around the perimeter of plate A lie perimeter points a through h, labeled clockwise in the same fashion as in FIG. 1(*a*), with similar points on plate B labelled i through p. FIG. 3(*a*) depicts plate B positioned to the right of plate A, so that side c—d of plate A abuts side o—p of plate B.

The means for retaining these plates in an array are endless filaments 100 and 200. Each such filament is an endless loop, the length of which is chosen based upon the pattern followed in positioning the filaments, as detailed hereafter. Filaments may be formed from various suitable materials known to the art, and may have cross-sections of rectangular, square, ellipsoidal, circular or other form. Preferably, filaments are formed from nylon monofilament and have a circular cross-section with a diameter of about 0.4 mm.

To form an endless loop, it is preferred to cut a single strand of filament to a length double that of the loop and to join the ends of the strands with a suitable joining means. The prime requisite for the joining means is that it not interfere with the interaction of abutting plates, as will be more fully understood upon consideration of that interaction, set forth below. A preferred joining means is a metal sleeve, having an outside diameter only slightly larger than that of the filament, and formed of a relatively soft metal, chosen from among such materials available to the art. The sleeve is crimped around the ends of the filament after abutting same. Alternately, the filament ends may be coated with adhesive and placed in mutual contact for a time sufficient to bond the ends together. Another joining means could be a clear plastic sleeve having an inside diameter approximately equal to the outside diameter of the filament. Ends of the filament are coated with a suitable adhesive, as will be known to those in the art, and then inserted into the sleeve. Heat treatment may be conducive to setting such adhesive. Those in the art will be able to understand these and other methods for joining the filaments.

The filaments lie within the grooves as shown in FIG. 2(*c*). It is important to note that each filament is free to slide lengthwise within a groove, and is not attached to the plate in any manner. As explained below, the filaments cooperate with the plates during the operation of the invention. In doing so, the filaments have occasion to move slightly in a longitudinal direction. The fact that the retaining means are not affixed to the plates marks a signal departure from the prior art.

Figure 4A:
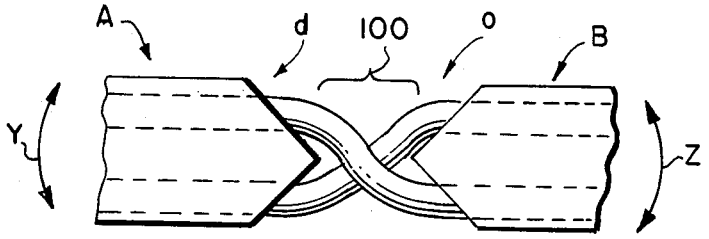
FIG. 4(*a*) is a detail side view of the area IV(*a*) of FIG. 3(*a*)
Figure 4B:
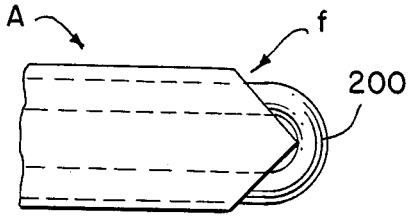

Filaments are placed in the plate surface grooves according to two basic principles. First, when a filament reaches a perimeter point, it makes a top-to-bottom transition, from the top surface to the bottom surface of a plate. Second, if the point lies on a side adjoining another plate, the filament path will continue in a straight line from one plate to the other, making a plate-to-plate transition as well as from top to bottom. If no plate adjoins that side, the filament path will turn 90 degrees in making the top-to-bottom transition, continuing on the opposite surface of the same plate. These principles are illustrated in FIGS. 3 and 4(*a*). For ease of understanding, the discussion that follows will take the plate orientation shown in the plan view of FIG. 3(*a*) as a reference point. Thus, the "top" surface of each plate is the surface seen in FIG. 3(*a*), and the "bottom" surface lies on the opposite side of each plate. Also, filament paths in which the filament lies in a top surface groove are shown as solid lines, while dashed lines show a path on the bottom surface.

A side view of the area around point f is detailed in FIG. 4(*b*), and there one can see that filament 200 passes from top surface groove g–f, around side f–e, and into bottom groove c–f. Conversely, at point d, shown in FIG. 4(*a*), filament 100 emerges from top groove a–d, passes between plates A and B, and enters bottom groove o–n on plate B. At the same points, filament 100 emerges from top groove j–o on plate B, passes the portion of filament 100 discussed previously, and enters bottom groove d–e on plate A. The effect of this action will be discussed more fully below.

It can thus be seen that the action of a filament at a perimeter point located on a side where two plates abut (e.g., points d and o) is to retain the plates; such points are referred to hereinafter as "hinge points." Similarly, at points where two plates do not abut (e.g., point f) the filament performs an anchoring function, helping to retain a plate within the array; such points are termed "anchor points."

Applying those definitions to the two-plate array of FIG. 3(*a*), one can trace each filament path to understand more clearly how the filaments and plates cooperate. Each filament, of course, is an endless element, but it is helpful to consider filament segments, defined as the portion of a filament lying within a particular groove in a given plate array. Starting with segment 201, it can be seen that filament 200 lies within bottom groove g–b on plate A. Arriving at point b, one can see that no plate abuts side a–b of that plate; therefore, the filament makes a top/ bottom transition and a 90 degree turn to enter top groove b–c as segment 208. Therefore, point b is an anchor point. At point c, however, plate B abuts side c–d; here, therefore, the filament makes top-to-bottom and plate-to-plate transitions, from the top surface of plate A to the bottom surface of plate B, entering bottom groove p–m. From there, the filament passes around anchor points m, 1, and i (segments 207, 206, and 205, respectively), making a top-to-bottom transition at each point. Proceeding to hinge point p (segment 204), the filament again makes top-to-bottom and plate-to-plate transitions. Segments 203 and 202 complete the loop, passing around anchor points f and g. The path of filament 100 can be traced in similar fashion.

One can thus see that the two plates are retained along sides c–d and p–o by virtue of the fact that two filaments cross at points c–p and d–o, each making top-to-bottom and plate-to-plate transitions, as seen in FIG. 4(*a*). The filaments restrain the plates from relative lateral movement at the hinge points, but the inherent flexibility of the filaments allows the plates to rotate about the axis formed by the hinge points, as indicated by arrows Y and Z (FIG. 4(*a*))

Thus, in this preferred embodiment, the presence of two hinge point defines a hinge, about which the plates may rotate. In the arrangement shown in FIG. 3(*a*), for example, plate B may rotate either up or down about the axis of sides c–d and p–o. It would be possible to construct other embodiments having a greater or lesser number of hinge points per side, the minimum, of course being one hinge point per hinge.

If the abutting sides c–d and p–o were permanently retained, the pair of plates could assume only a limited number of formations. The unique pattern of the filaments of the present invention, however, allows the plates the freedom to move relative to one another, forming a variety of arrangements. For example, plate B can be manipulated (as detailed below) to produce the arrangement of FIG. 3(*b*), wherein the line of contact between the plates occurs along sides a–b and i–j. Here, the hinges have "migrated" to points c, d, p and o (which have become anchor points), and points a, b, i and j have been converted into hinge points. As can be seen by inspecting the orientation of plate B's sides, one can observe that, in effect, plate B has been "rolled" around the upper right corner of plate A and has moved into an entirely new relationship with same.

Figure 5:
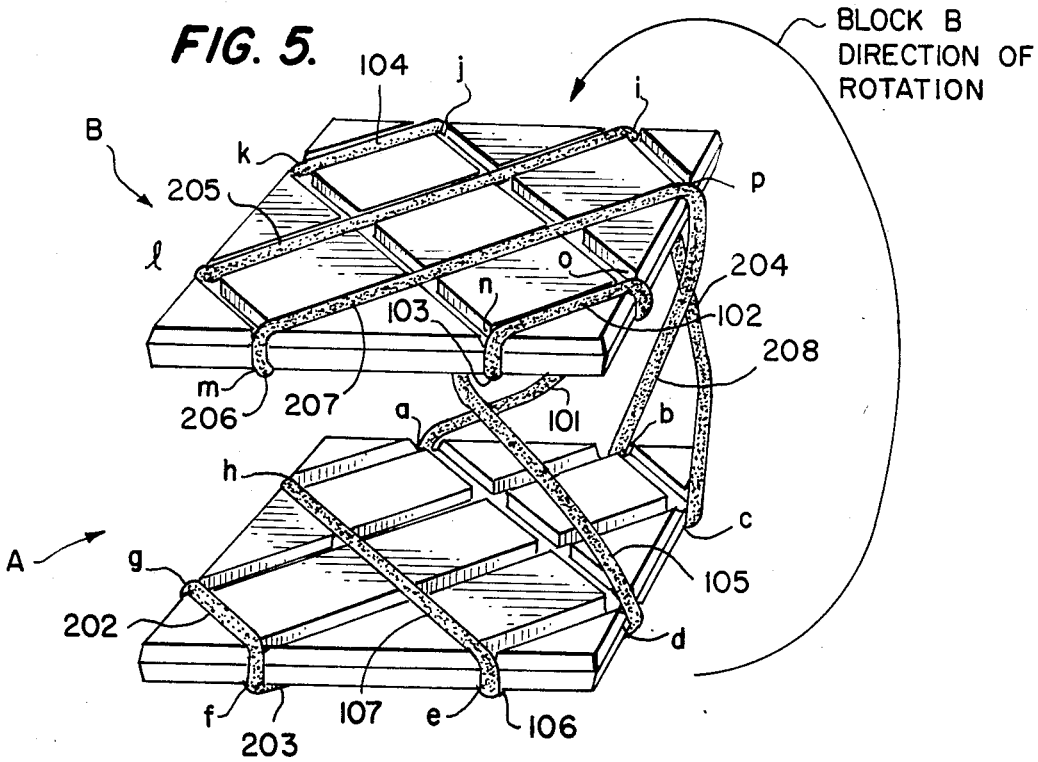
FIG. 5 is an exploded pictorial of the embodiment of FIG. 3.

The "rearrangement" of the two plates occurs in the following manner. Consider the orientation of the plates that exists when plate B is rotated around the axis of sides c–d/o–p, in an upward direction (as used herein, an "upward" rotation is a rotation out of the page—that is, perpendicular to the page and toward the reader; a "downward" rotation occurs in the opposite direction). The top surface of plate B thus describes a semi-circular arc, coming to the vertical and descending to make contact with the top surface of plate A. The resulting relationship between the plates can be conceptualized by reference to FIG. 3(*a*) and seen in the exploded pictorial of FIG. 5. The upper surface grooves of the two plates are in registration, so that filament segments 101 and 105, for example, lie side by side within a tunnel-like enclosure defined by grooves a–d and j–o. The same is true for segments 208 and 204 in grooves b–c and i–p.

Of course, one could return plate B to its former position by reversing the previous rotation, but cooperation between the plates and the filaments also makes a different rotation possible. Consider, for example, the path of segment 101, shown in FIG. 3(*a*), lying in groove a–d on the upper surface of plate A, retained at one end to segment 108 (bottom surface of plate A) and at the other end to segment 102 (bottom surface of plate B). As plate B rotates upward, from the position of FIG. 3(*a*) toward that of FIG. 5, segment 102 tends to pull segment 101 upward, wrapping around point o. An identical but opposite process operates on segment 105, with segment 106 pulling it downward to wrap around point d. When the plates have fully rotated into contact, this process results in segment 105 being urged toward groove a–d and segment 101 toward groove j–o; the two segments have equal access to both grooves. This process occurs in the same manner for segments 208 and 204, as inspection of FIGS. 3(*a*) and 5 reveals.

As a consequence, the hinges formed by the former crossover of filaments at points d/o and c/p disappears, the filaments at these points making only top-to-bottom (and not plate-to-plate) transitions. The notation employing the "/" between points, sides or grooves denotes that the two structures are abutting one another, as are the points d and o, as well as c and p in the figure. These hinges would be reconstituted upon side k–l being rotated upward, allowing the plates to return to the position of FIG. 3(*a*). Further, perusal of FIG. 5 indicates that side o–p cannot rotate upward (i.e., around the axis of sides k–l/g–h) as it is restrained by the segment pairs 101/105 and 204/208, extending from points a/j to d/o and b/i to c/p, respectively. That arrangement also prevents rotation of side i–j about sides m–n/e–f. No pair of segments prevents the upward rotation of side m–n, however, and upon rotating that side upward, segment 104, wrapping around point j, pulls segment 105 completely into groove a–d. Segment 101 similarly moves into groove j–o; thus, the two segments swap places. This process occurs in the same manner for segments 208 and 204, as an inspection of FIGS. 3(*a*) and 5 reveals. The shift of segments 101/105 and 208/204 results in the creation of new hinges (filament crossover points where filaments make plate-to-plate transitions) at points a/i and b/j , enabling plate B to rotate about the new axis formed by sides a–b and i–j, to the position of FIG. 3(*b*). The hinges have thus "migrated" around the plate by 90 degrees.

Returning to the position shown in FIG. 3(*a*), if plate B is rotated downward around the axis of sides c–d and o–p until the bottom faces of the two plates make contact, and then rotated about the axis of sides a–b/i–j, plate B would then assume a position "rolled" clockwise around plate A, with an axis of rotation defined by sides f–e and n–m. Again, the hinges migrate by 90 degrees, but in a direction opposite that seen above. Clearly, one could perform successive rotations of the two plates to obtain abutment between the plates at any side desired.

Although plates within an array can change position within the array, the fact that arranging the filaments to make top-to-bottom transitions dictates that the top and bottom surfaces of plates cannot reverse themselves. That is, if one begins with an array of plates in a flat position, and then manipulates the array through various configurations, and returns to a flat position, the plate surfaces that constituted the original top and bottom surfaces will continue to be aligned, regardless what plate sides are in mutual contact in that position.

Thus, it can be said that in any orientation, a pair of retained plates has three hinges: a "present" hinge, defined by the present existence of two hinge points on an abutting side, and a pair of "alternate" hinges, to which the present hinge can migrate, consisting of the two sides lying at 90 degrees to the present hinge. A present hinge migrates to an alternate hinge when one plate is rotated upward or downward about the present hinge until the plates make surface contact, and then further rotated about the alternate hinge. When inspecting two retained plates, one can identify the direction of rotation of an alternate hinge by examining the ends of the present hinge. If the upper surfaces under examination are brought together (e.g., in FIG. 3(*a*), by rotating plate B upward as discussed), then the alternate hinge will form at the end of the present hinge where short grooves (e.g., b–c or i–p) carry filaments on the upper surface.

Figure 6:
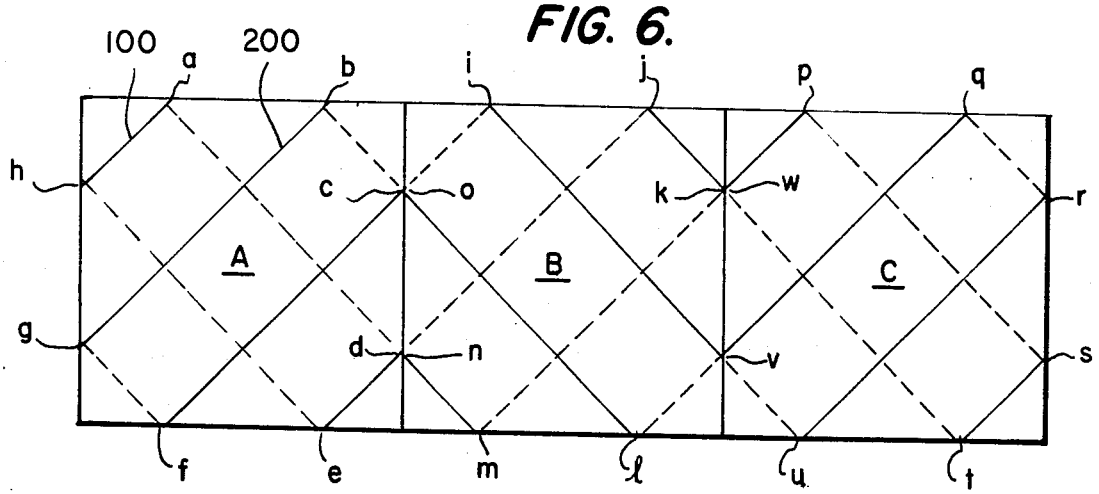
FIG. 6 is a plan view of a three-element embodiment of the invention.

The principles set out above can be employed to assemble arrays having many elements. FIG. 6 depicts a three-element array, in which plates A, B, and C are retained by two filaments 100 and 200. Inspection of the drawing reveals that addition of the third plate does not alter the method in which the filament paths proceed. Filament 100, for example, follows a path that can be traced through top groove a–h, bottom groove h–e and top groove e–d, passing around anchor points h and e, and then passing to the underside of plate B at point d/n. Also, manipulation of this embodiment confirms the manner in which the hinges operate. If plate A is rotated upward about the hinge formed at sides c–d/n–o, the principle stated above would predict that the alternate hinge would form on sides e–f/l–m, and operation of the embodiment confirms that prediction.

Figure 7:
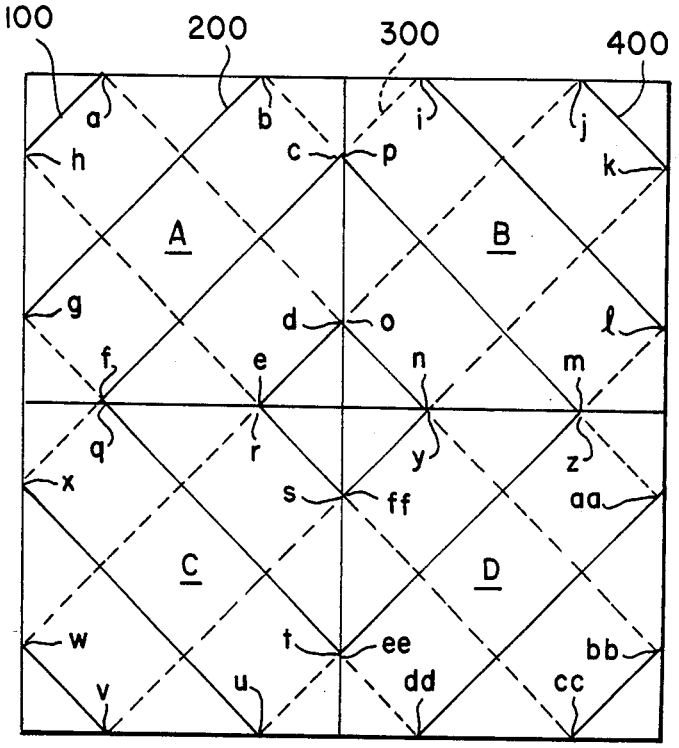
FIG. 7 is a plan view of a four-element embodiment of the invention.
Figure 8A:
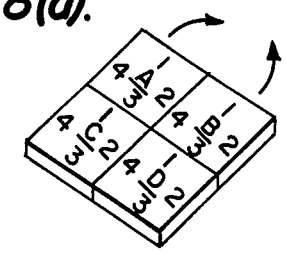
FIGS. 8(*a*)–(*e*) are pictorials illustrating one method of manipulating the embodiment of FIG. 7.
Figure 8B:
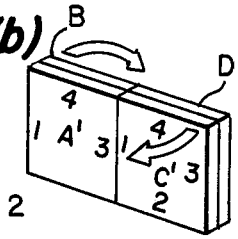
Figure 8C:
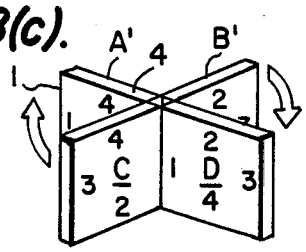
Figure 8D:
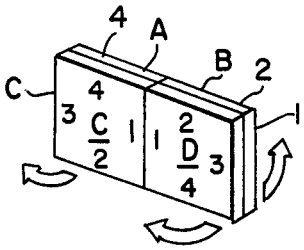
Figure 8E:
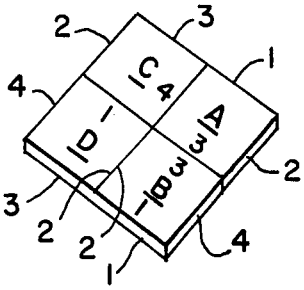
Figure 9A:
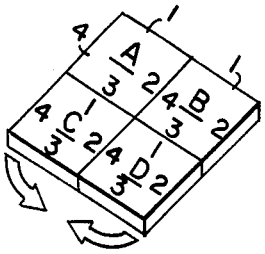
FIGS. 9(*a*)–(*e*) are pictorials illustrating an alternate method of manipulating the embodiment of FIG. 7.

Two-and three-element units can be used as subassemblies in constructing more complex arrays. In particular, it is possible to assemble arrays in which elements can be linked to several other elements, rather than only to one other as seen in the embodiments heretofore presented. Further, it is possible to construct arrays in which the elements can form an endless chain, rather than the open-ended structures discussed above. For example, FIG. 7 shows a four-element array in which plates A, B, C and D are linked in an array by filaments 100, 200, 300 and 400. Several important differences between this arrangement and those discussed above should be noted. First, this array does not constitute an open-ended chain, as has been true of arrays presented in prior embodiments. Second, each of the four filaments makes contact with each of the four plates, producing a more complex hinge structure than seen heretofore. Third, the hinges are not formed at points where a filament crosses over itself in making plate-to-plate tansitions, but by two separate filaments making such crossovers. At point c/p, for instance, the hinge is made up of segments of filaments 200 (passing from bottom groove b–c in plate A to top groove m–p in plate B) and 300 (passing from bottom groove i–p in plate B to top groove c–f on plate A).

The migrating hinge structure of the present invention permits interesting shifts in plate orientation within the array, illustrated in FIG. 8(*a*)–(*e*) and FIGS. 9(*a*)–(*e*). The discussion relating to each of these Figures takes as a starting point the four-element array of FIG. 7. The filament arrangement is the same as shown in that Figure, but to promote clarity the filaments are omitted. Plate sides are labelled with numerals 1–4, and referred to as, for example, side Al. Further, the plate surface visible in FIG. 8(*a*) is termed the "top" surface; when the "bottom" surface is visible (due to manipulation of the array), a "prime" symbol will be attached, e.g., a reference to side A'3 will indicate that the bottom surface of plate A is visible in the respective drawing at that point, and will be so shown in the Figure. As with previous discussion, an "upward" rotation denotes rotation perpendicular to the page (toward the reader) and vice versa.

Starting with the array of FIG. 8(*a*), and referring also to FIG. 7, one can see that the array can be manipulated to the vertically-oriented position of FIG. 8(*b*) by rotating plates A and C as one unit, and plates B and D as a second unit, around the axis formed by the line of contact of sides A2/B4 and sides C2/D4. Study of FIG. 7 reveals that the "new" hinges formed by this manipulation migrate to sides A3/B3 (for plates A and B) and sides C1/D1 (for plates C and D). Of course, these lines of contact are positioned alongside one another at the center of the structure, and if the respective plates are rotated about those axes, as illustrated in FIG. 8(*b*), the resulting angular movement forms a "start" arrangement, seen in FIG. 8(*c*). Continuation of that rotation, as in FIG. 8(*c*), results in the bottom sides of plates A and C and plates B and D coming into contact, shown in FIG. 8(*d*). In this orientation, the hinge structure permits upward rotation of sides C2 and D4, again forming a flat array, as shown in FIG. 8(*e*).

It will be observed immediately that the manipulation described above produces a different relationship among the plates. FIG. 8(*e*) depicts the array with the same side visible as that shown in FIG. 8(*a*). Here, however, plate A occupies the upper right corner, not the upper left. Plate C not only has moved from the lower left to the upper left, but also its sides have "rolled" with respect to plate A, so that sides A4 and C4 are in contact. Similarly, plate D has moved left within the array, from lower right to lower left, and plate B has travelled down from upper to lower right and also has "rolled". None of the sides in mutual contact in FIG. 8(*a*) remain in contact after this set of manipulations; the relationships between individual array elements has been completely altered.

These changes in relationship between individual elements of the array marks an important departure from all prior art devices. Although some of the devices known in the art could be manipulated to achieve a variety of shapes, the relationship between individual elements invariably was preserved, and indeed is inherent in the modes of construction seen in such devices. Application of the principles of the present invention allows the creation of an array within which individual elements "float" to different positions as the hinges migrate.

A further variation made possible by the present invention can be seen in FIGS. 9(*a*)–(*e*). The starting array of FIG. 9(*a*) is identical to that of FIG. 8(*a*), and the same plates are rotated around the same axis, but in this instance the array is rotated is downward rather than upward. Referring to FIG. 7 and the principles underlying the formation of migrating alternate hinges, one can see that a downward rotation, to the position of FIG. 9(*b*), would result in the hinges migrating to sides A1/B1, A3/C1, B3/D1 and C3/D3. Rotation about those axes is possible by pulling lines of contact A3/Cl and B3/Dl outward, as shown by the arrows of FIG. 9(*b*), to create an endless chain, or solid quadrilateral, seen in FIG. 9(*c*). If that motion is continued, one arrives at the vertically-oriented array of FIG. 9(*d*).

That arrangement can be further manipulated by rotating sides C2, D4, A2 and B4 downward, around the axis formed by sides C4/A4 and B2/D2, depicted in FIG. 9(*d*), returning to a flat array. FIG. 9(*e*) shows the resulting array with the same top surface seen in FIG. 9(*a*) (it being understood that after the rotation of FIG. 9(*d*) the device would lie with the bottom surfaces visible to the reader). As can be observed, the plates appear in yet another relationship, with plate A in the lower right corner, plate B in the upper right, plate D at the upper left and plate C at the lower left.

Consideration of the many variations possible through the different modes of manipulating the array makes clear that one can arrive at a multitude of different arrangement of the individual plates, both in the form of flat arrays and solid shapes.

Figure 10A:
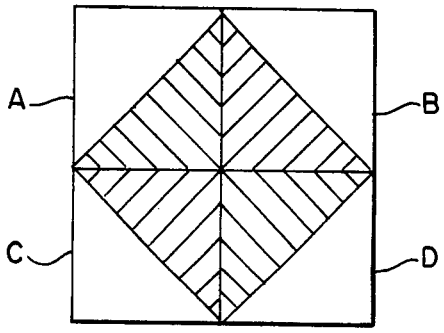
FIGS. 10(*a*) and (*b*) are plan views showing the effects of the manipulation of FIGS. 8(*a*)–(*e*)
Figure 9B:
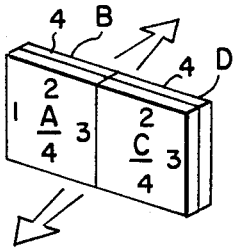
Figure 9E:
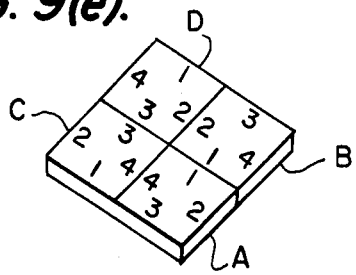
Figure 9C:
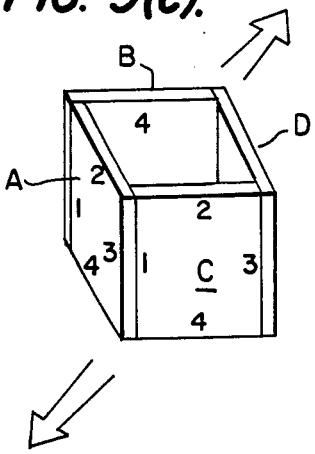
Figure 10B:
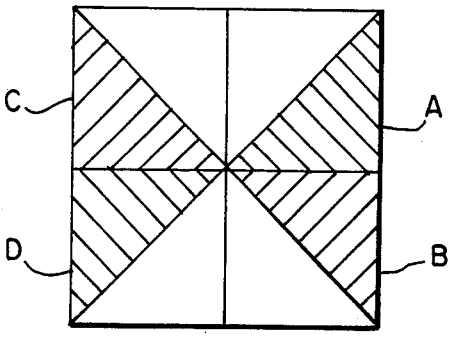
Figure 9D:
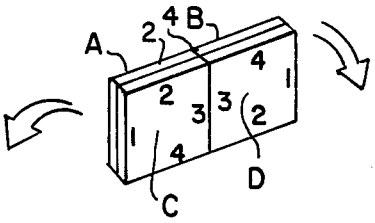

One can take advantage of the fact that the plates "float" within the array to create a puzzle or similar device that changes appearance based upon the orientation of the plates. For example, the four-plate array of FIG. 10(*a*) has a geometric pattern of diagonally-divided light and dark areas, carried on the graphic insert of each plate. As seen, the beginning pattern forms a diamond. If the array is manipulated as illustrated in FIGS. 8(*a*)–(*e*), the resulting array seen in FIG. 10(*b*) forms an entirely different pattern, depicting an hourglass-like design. Those in the art will appreciate the potential of this device for providing puzzles, games, advertising media, and the like.

Assembly of the array of FIG. 7 can proceed by directly constructing the flat arrangement shown there, or more readily by utilizing one of the variant orientations. Construction of a flat array is assisted by a jig 50, shown in FIGS. 11(*a*)–11(*c*). As seen, this jig includes a base 52, carrying a mounting spindle 54, which is freely rotatable. A retainer 56 is fixed to the top of the spindle. Preferably this element is generally square and flat, with edge holders 511, notched to receive the side of a plate, at each corner. Assembly begins by placing the four plates A–D on the retainer, with plate corners fitted into edge holders so that each edge holder engages two plates, and the array lies on the flat retainer surface but rotated 90 degrees with respect to that surface.

Figure 11A:
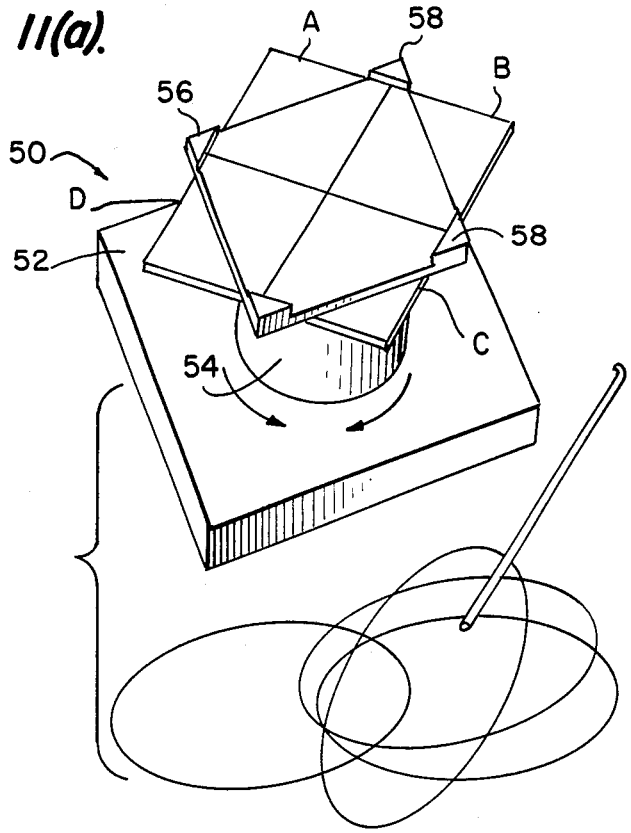
FIGS. 11(*a*)–(*c*) are pictorials illustrating a method of assembling the embodiment of FIG. 7.
Figure 11B:
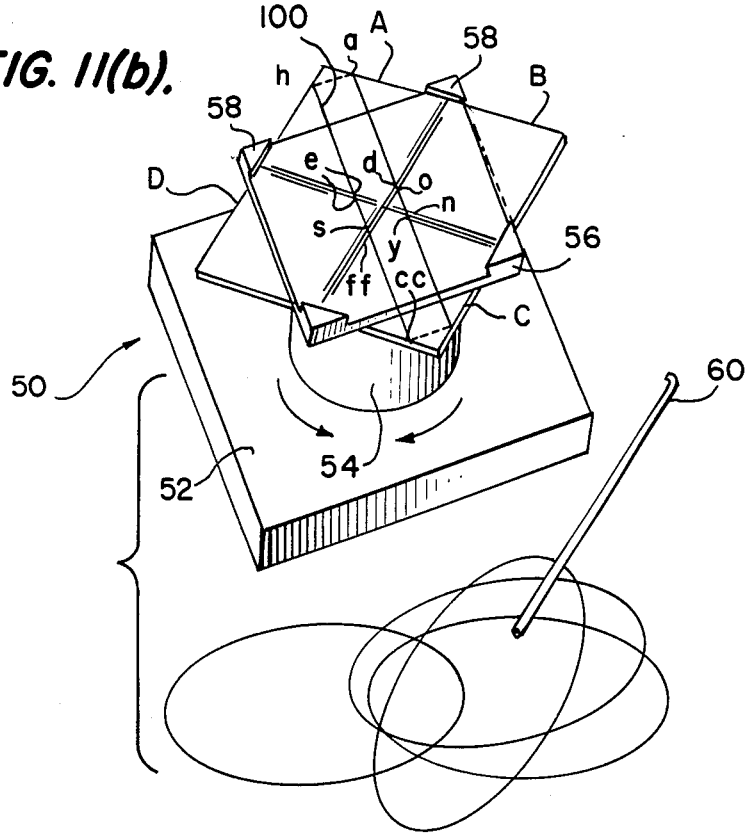
Figure 11C:
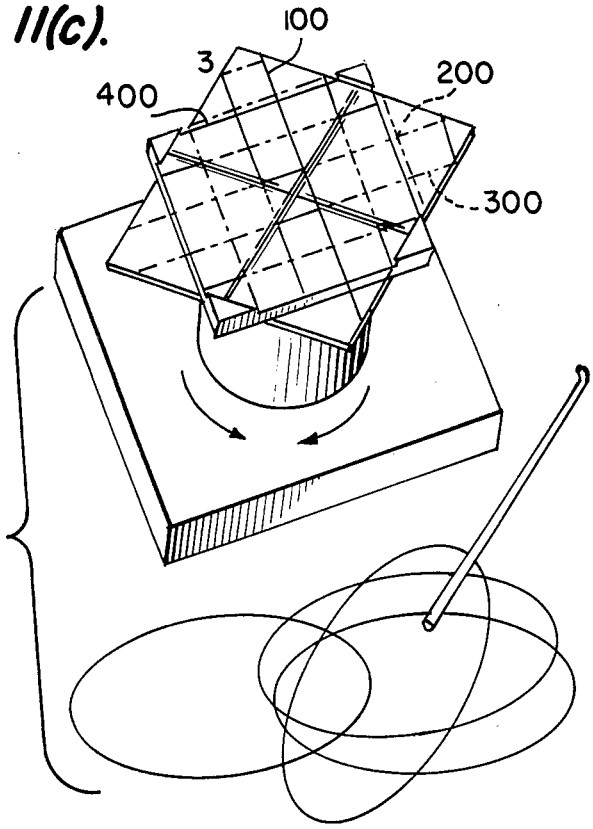

Installation of the filaments begins as shown in FIG. 11(*b*). Filament 100 is looped over the protruding corner of plate A and fitted into bottom groove a–h, and the filament portions running from points a and h are laid in grooves a–d and e–h, respectively. Following the principles outlined above, the filament segments then pass under plates B and D, in bottom grooves n–o and r–s, and proceed to plate D, where they are placed in top grooves y–bb and cc–ff, finally looping over the corner of that plate to lie in bottom groove bb–cc. The final step of passing the filament over the corner of plate C must be done with care to avoid stretching the filament or disrupting the array, and it has been found that a tool, such as filament hook 60, is helpful in accomplishing that result.

In a similar manner, filaments 200, 300, and 400 are installed, as can be seen in FIG. 11(*c*). The spindle can assist the process, as it allows the operator to position the array as desired for ease of placing the filament segments in their respective grooves.

Figure 12A:
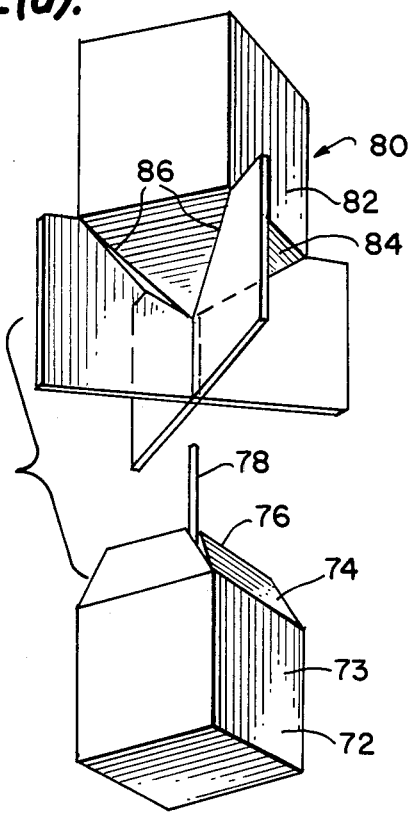
FIGS. 12(*a*)–(*c*) are pictorials illustrating an alternate method of assembling the embodiment of FIG. 7.
Figure 12B:
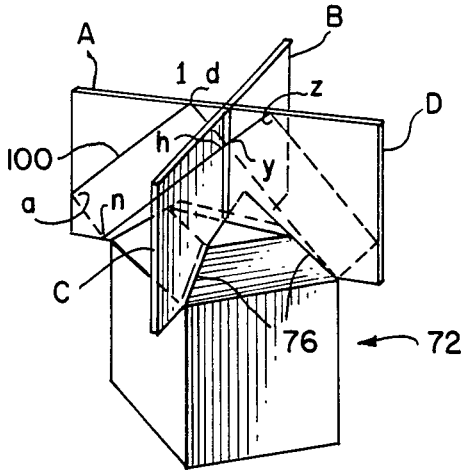
Figure 12C:
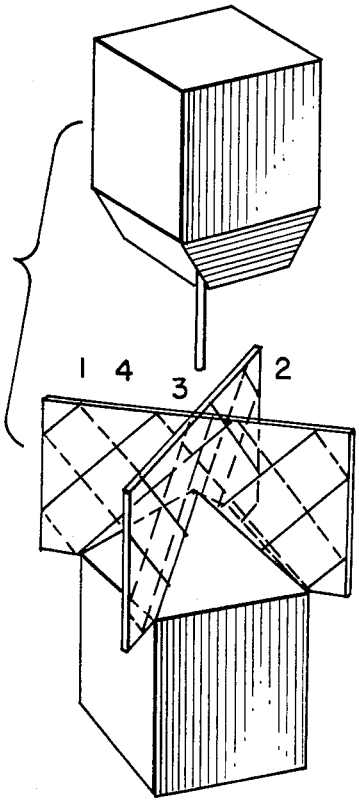

A more convenient assembly technique is illustrated in FIGS. 12(*a*)–(*c*). This method employs the "star" orientation of the plate elements, discussed above. To hold the individual plates in position during assembly, a two-piece star jig 70 is used. The bottom jig 72 preferably includes a bottom portion 73, formed as an upright, rectangular solid, and a bevelled portion 74 in the form of a truncated pyramid the sides of which extend between the vertical sides and the flat top of the jig. Notches 76, sized to accept the thickness of a plate closely but not tightly, are cut across the top of the jig, joining opposed corners. These notches extend in depth from the top of the jig to the intersection of the bottom portion and bevelled portion, so that a plate received into a notch will be positioned completely vertical with respect to the work surface. This jig has a width approximately equal to that of a single plate, so that a plate positioned in a notch with an edge at the center of the jig will have its outer corner extending away from the jig. A mandrel 78 extends upward from the center of the jig, preferably for a distance such that the tip of the mandrel lies at a position slightly below that at which the upper grooves intersect the side of a plate, as illustrated in FIG. 12(*b*). The mandrel preferably has a square cross-section and is sized to maintain spacing between plates to facilitate installation of filaments.

The top jig 80, shown in FIG. 12(*a*) being held opposite the bottom jig, as will be explained below, is similar in shape to the bottom jig, with a rectangular bottom portion 82 and a bevelled portion 84. The latter, however, here is completely pyramidal in shape, with no center mandrel. Notches 86, similar in size and location to those of the bottom jig, also are provided.

This assembly technique commences by positioning four plates A–D in bottom jig notches 76, as seen in FIG. 12(*b*). It should be noted that the reference letters for the plates have been assigned based on the relative plate positions shown in the "star" orientation of FIG. 8(*c*), so that if one begins with plate A and move clockwise, one encounters plates A, B, D, and C, in that order. It also will be apparent that attention must be paid to the orientation of any graphics sheets carried in the plates, to insure that any design planned for the product will emerge as envisioned.

Installation of the filaments begins by looping filament 100 over the lower protruding corner of plate A, into groove a–h, and then placing the two portions of the filament grooves a–d and e–h. Unlike the previous method, however, in which the filaments generally were looped over anchor points at the end of the installation process, here the filament must wrap around point d, following the stated path principles. The filament then passes to the plate aligned parallel to plate A, plate D. In passing the filament to plate D, however, it must be remembered that the sides of plates A and D that meet at the center of the jig do not form a hinge (see the discussion related to FIG. 8, above). Therefore, the filaments do not make a top-to-bottom transition, but continue on the same side, and loop around the exposed corner of plate D. The jig is then rotated horizontally by 90 degrees, and filament 400 is installed on plates B and C in a similar manner.

At this point, the top jig is fitted over the bottom jig, with top jig notches 86 engaging the plates. The entire assembly is turned over, and the bottom jig is removed, leaving the top jig holding the plates, as shown in FIG. 12(*c*). The plates now are in a position relative to the top jig that is identical to the position relative to the bottom jig shown in FIG. 12(*b*), and installation of the remaining filaments 200 and 300 can proceed in exactly the same manner as described above. When all four filaments are in place, the completed array is removed from the jig and manipulated into whatever orientation is desired for packaging and shipping.

Figure 13A:
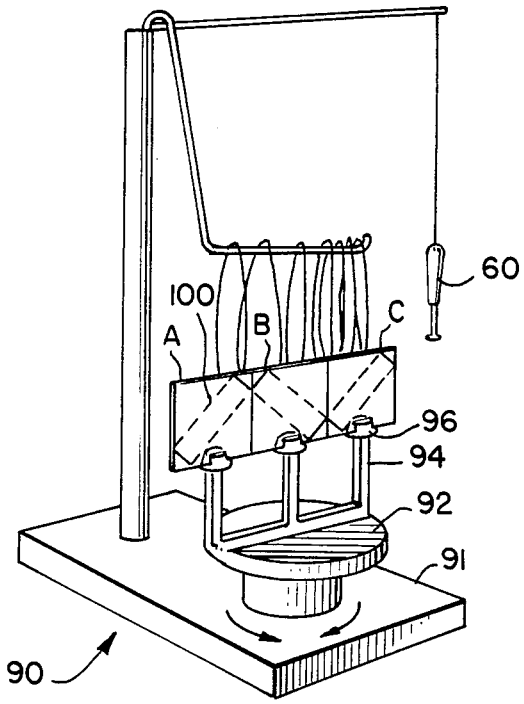
FIGS. 13(*a*) and (*b*) are pictorials showing a method of assembling the embodiment of FIG. 6.
Figure 13B:
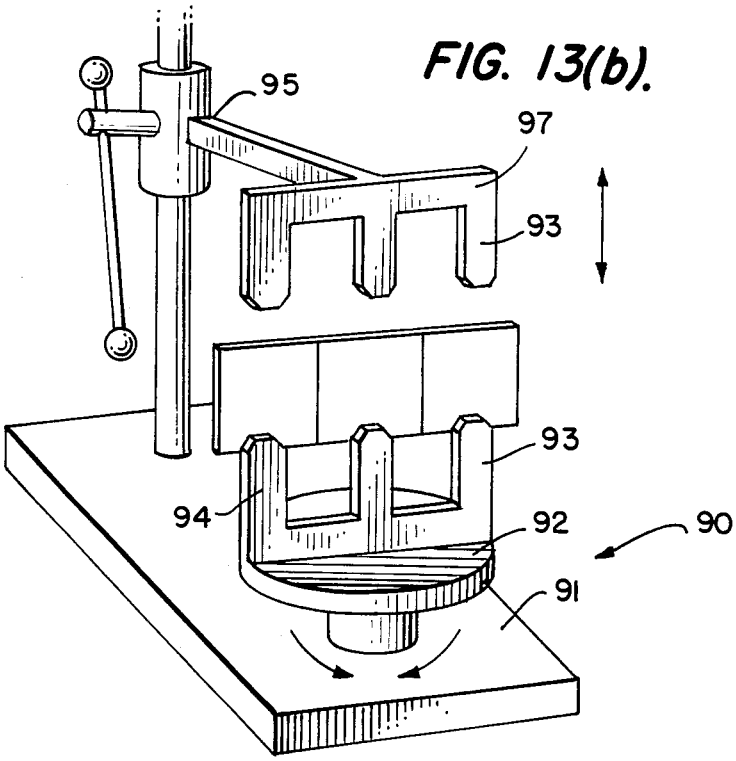

The methods discussed heretofore are excellent for constructing four-element arrays, but other techniques are required for units based upon the three-element configuration. FIG. 13 illustrates a three-element assembly jig 90, suitable for rapidly producing such devices. There, a rotating table 92 is carried on a base 91, with three carrier arms 94 extending upward from the table. At the tip of each carrier arm there is provided a holder 96, notched to accept a plate in firm engagement. It has been found convenient to arrange this jig in a workstation, as shown, with a filament tool and extra filaments located to facilitate productivity.

Plates A, B, and C are then fitted into their respective holders for assembly, and filaments 100 and 200 are installed on the plates. It will be noted that here the filament paths follow the stated rules exactly, either wrapping around the outer edge of a plate to form an anchor point or making top-to-bottom and plate-to-plate transitions for form hinge points. The holders should be sized to overlap each plate only in an area between two points, to allow efficient filament installation.

An alternative form of the three-element jig is shown in FIG. 13(*b*). There, the carrier arms 94 are provided as portions of a carrier assembly 93, formed in the shape of the letter "E". As shown, the holders 96 here are formed directly into the tips of the carrier arms. Added stability during assembly may be obtained by also providing an upper carrier assembly 97, mounted on moveable arm 95. When the plates are placed into the holders of the lower assembly 93, the upper assembly is lowered into a position such that the holders of that assembly also engage the plates to insure that the plates remain in their proper orientation during filament installation.

It will be appreciated that the goal of creating entertaining and challenging puzzles, games and the like will better be achieved by providing arrays with a greater number of elements than those discussed heretofore. One method found most convenient to form such arrays by employs the three-element unit discussed above as a base, adding additional elements as required. For example, a six- element array can be assembled as shown in FIG. 14, in which plates A, B, C, D, E and F are retained by filaments 100, 200, 300, 400, 500 and 600.

Assembly of this unit proceeds as follows. First, plates A, B and C are retained by filaments 100 and 200, as described above. Then, plates E, F and A are assembled as a three-piece unit utilizing filaments 300 and 400. Assembly of this unit disregards the presence of the plates B and C in placing filaments in their appropriate grooves. Finally, plates C, D and E are retained by filaments 500 and 600, again disregarding the presence of the other plates. It is important to note that the construction of each stage of this assembly proceeds in exactly the same manner. It has been found that the presence of already-retained plates does not impede the addition of other elements.

Figure 14:
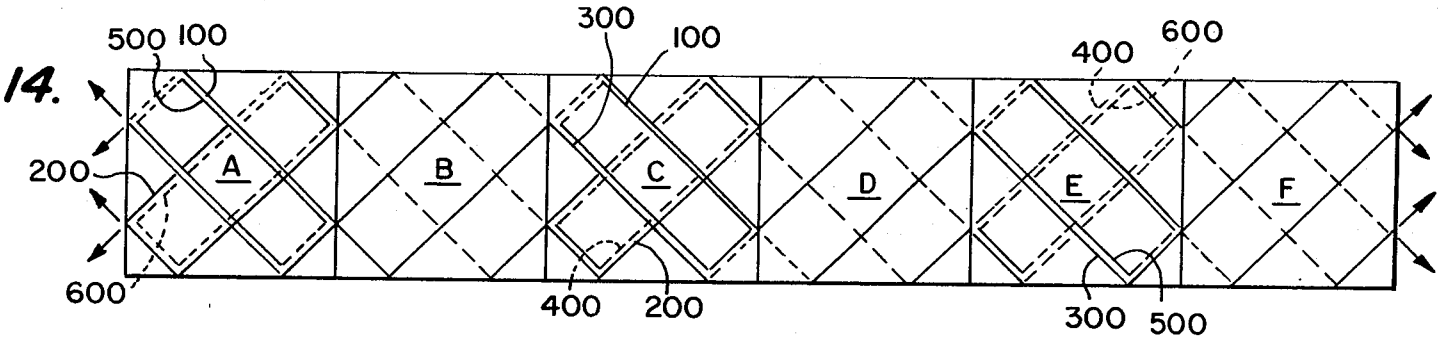
FIG. 14 is a plan view of a six-element embodiment of the invention.

As seen, the six-element unit presented in FIG. 14 requires six filaments. An alternate arrangement, shown in FIG. 15(*a*), accomplishes the same task with only four filaments, by employing a "long-line" assembly mode. Rather than restricting filaments to only three plates, this mode of construction allows a single filament to span all six plates, but this pattern may pose a risk that filaments may become dislodged from the grooves. In examining the filament patterns discussed above, it becomes apparent that each layout required a filament to occupy four grooves on a given plate—two "long" grooves and two "short" grooves. In tracing filament paths, one could say that a filament followed a "back and forth" pattern on a given plate, running in one direction in two grooves and the opposite in two others. The pattern of FIG. 15(*a*) differs from that concept in having each filament occupy only two grooves on each plate, a "long" groove and a "short" groove. Thus, a filament never crosses itself in forming a hinge, which assists in maintaining the filaments within the grooves. Those in the art will understand that reducing the number of filaments required to achieve a given-size array will markedly reduce the cost of production, due to the enhanced productivity potential, and thus the risk could be justified.

Figure 15A:
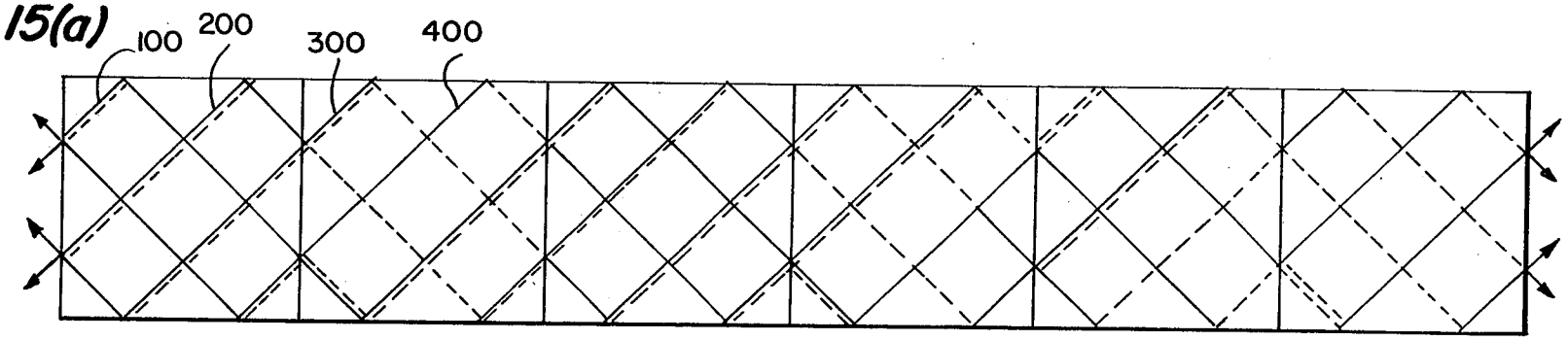
FIG. 15(*a*) and (*b*) are plan views of an alternative six-element embodiment of the invention, respectively manipulated to form an endless chain and a flat array.
Figure 15B:
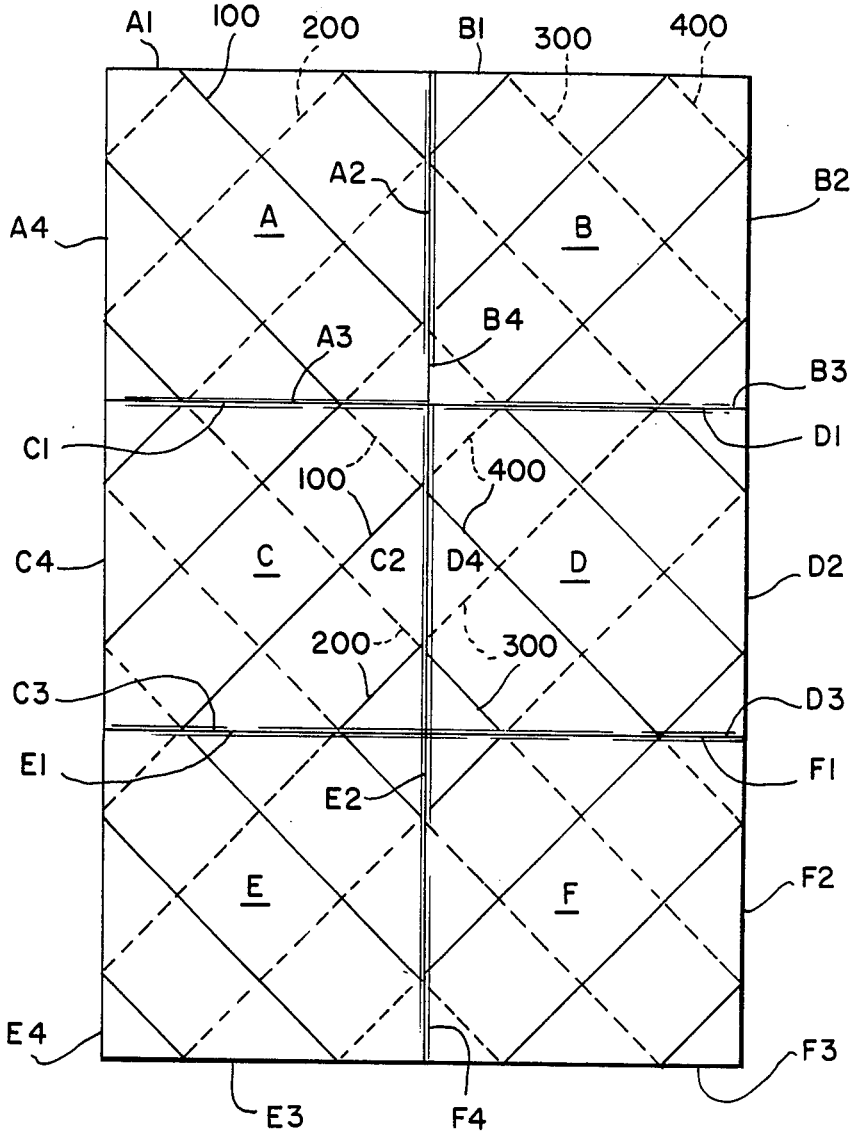

After appropriate manipulation, the array of FIG. 15(*a*) can take on the form of a flat plate, as seen in FIG. 15(*b*). In tracing the filament paths in this Figure, it will be helpful to note that the line of abutment formed by sides C2 and D4 does not form a hinge; as shown, filaments wrap around respective sides to form anchor points.

Figure 16:
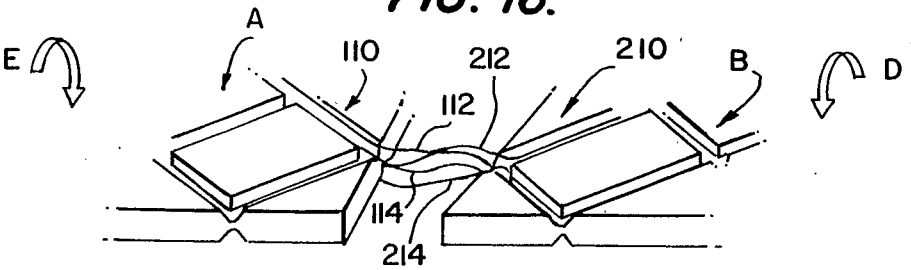
FIG. 16 is a detail, exploded pictorial depicting an alternate embodiment of the invention.

As mentioned previously, it is important to retain the filaments within the grooves to maintain array integrity. To achieve that objective, it has been found helpful to employ filaments in pairs, as shown in FIG. 16. That Figure is a detail pictorial, exploded for clarity, with two pairs of filaments, 110 and 210, passing between plates A and B to form a hinge. Rather than simply passing side-by-side, as would necessarily be true with single filaments, one filament 212 of pair 210 passes between filaments 112 and 114 of pair 110, and similarly, filament 114 lies between filaments 212 and 214. Comparing that arrangement with the two-filament hinge best seen in FIG. 5, it is apparent that the former is better able to maintain its position despite the application of a twisting force to the hinge. If, for example, a twisting force in the direction of arrow D were applied to the plates, filament 212 is not free to move out of position, as it is clamped in place by filaments 112 and 114. An opposite twisting force, in the direction of arrow E, would result in an identical retentive action on filament 114 by filaments 212 and 214. It has been found that employment of filament pairs materially improves the durability of an array, particulary if such array is subject to manipulation by children. The addition of the extra filaments, and their interlocking relationship does not interfere with the migration of hinges during manipulation of an array.

Figure 17A:
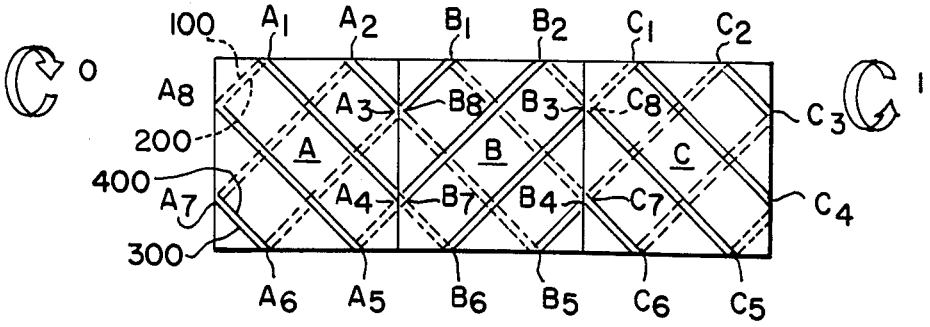
FIGS. 17(*a*)–(*d*) are progressive plan views illustrating the assembly of an eight-element embodiment of the invention.
Figures 17B, 17C, 17D:
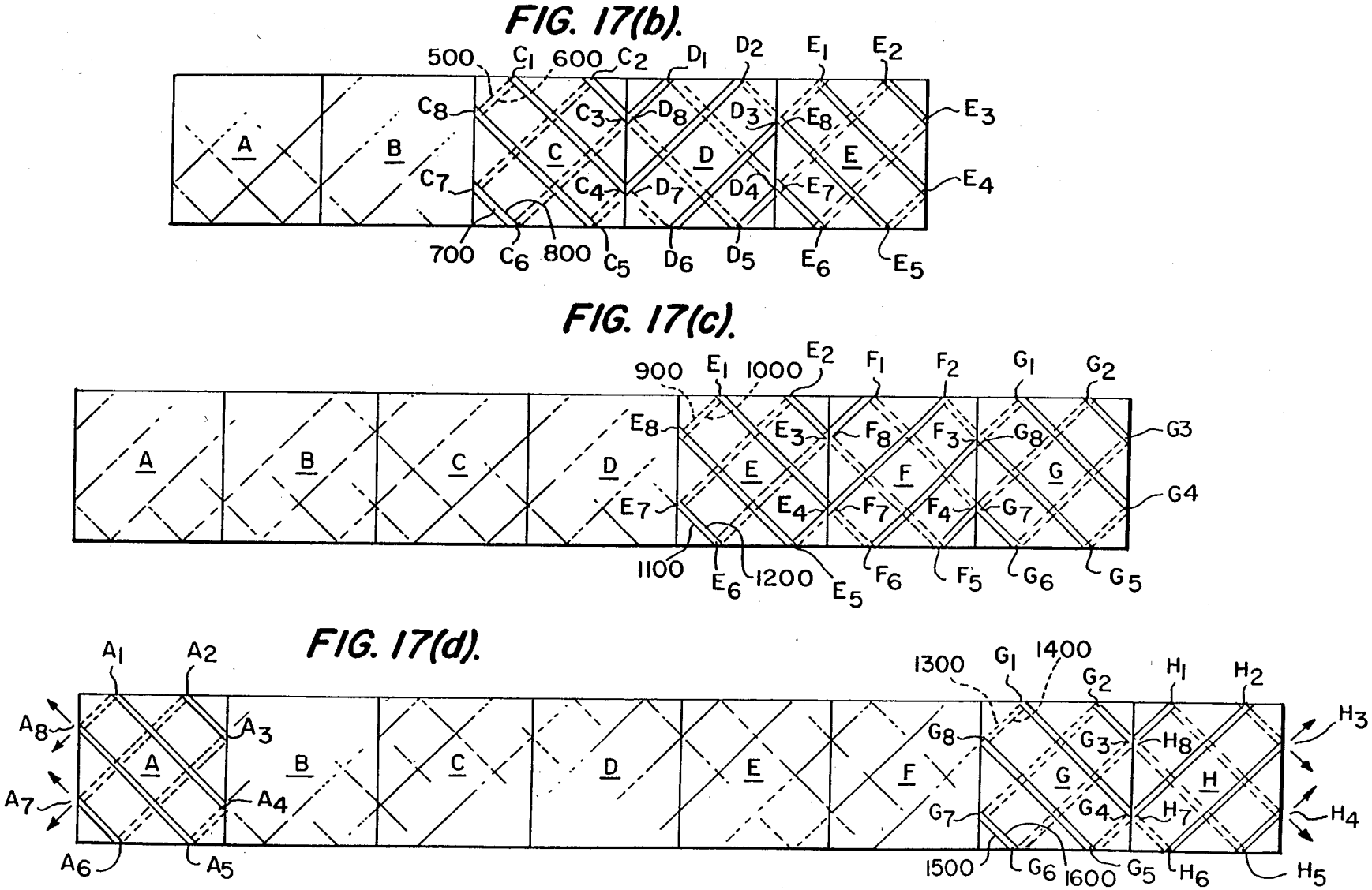

A preferred method of assembling arrays having many plates is shown in FIGS. 17(*a*)–(*d*), depicting a preferred eight-plate array. Given the number of plates involved in this embodiment, individual side points will not be enumerated as was done previously but will be denoted by subscripts to the letter designations of the plates, e.g., point A1. Also, successive phases of the Figure will show only those filaments added during that phase of assembly, to assist in visualizing the device. Further, filaments lying the same groove are shown as slightly separated for clarity, but it will be understood that in fact such filaments are in close mutual contact.

Construction of this embodiment commences by aligning three plates A, B and C in lengthwise abutment. A filament 100 is looped around the underside of plate A at points A1 and A8, lying in the lower surface groove between them, and then laid in upper surface grooves A1–A4 and A8–A5. From point A5 a section of the filament wraps around that point and passes through the short underside groove. The filament crosses over itself in making the plate-to-plate transition at point A4/B7. In similar fashion, the filament passes across the upper surface grooves B7–B2 and B6–B3 of plate B and make another plate-to-plate transition at point B3/C1. Crossing plate C, the filament is then looped over the corner of that plate, around points C4 and C5. Filament 200 follows an identical path.

In causing a filament to make the plate-to-plate transition at the hinge points A3/B1 and B3/C1, the filament must be twisted, and therein lies and important point. The twisting can be accomplised in either of two directions—"inward", as shown by arrows I, or "outward" as shown by arrows O. To achieve the pattern described above, in which the filament pairs do not simply cross but intertwine, one filament is twisted the same way at both such points, and the other is twisted in the opposite direction. For example, filament 100 may be twisted "inward" at both such points, and filament 200 twisted "outward." The key point is that filaments be twisted in opposite directions.

Filaments 300 and 400 are looped over the plates in similar fashion, starting with the corner of plate A lying between points A7 and A6, forming anchor points at A3/B8 and B4/C7, and looping finally around the corner of plate C between C2 and C3. It has been found convenient to make the final loops around the corners noted, and thus helpful to turn the arrary over when installing filaments 300 and 400. Again, the twisting of the filaments is important, with filament 300 being twisted "inward" and filament 400 "outward."

The unit is expanded by adding two additional plates D and E, as seen in FIG. 17(*b*). These elements are abutted lengthwise to those already assembled, and filaments 500, 600, 700, and 800 are looped over plates C, D, and E in exactly the same pattern as that used for plates A, B and C. The twising pattern remains important, and is done in exactly the manner described above. That procedure is repeated, as shown in FIG. 17(*c*), to add plates F and G to the array.

The array is completed by adding plate H between plates G and A, depicted in FIG. 17(*d*). As with previous phases of assembly, these three plates are retained by four filaments 1300, 1400, 1500 and 1600, looped around the plates without regard for the other plates or for filaments previously installed (e.g., filament 100 on plate A). The array at this point is an endless chain, and manipulation can convert it to a flat sheet, with particular plates in variable positions, or into a variety of solid shapes. As with the other arrays discussed above, the hinges formed by filament crossovers migrate around the sides of a plate, allowing the plate to "float" within the array.

Although it is preferred to employ square plates, a variety of sizes and configurations is possible. Indeed, the array elements need not be plate-like, but may be solids, such as cubes. The relationship between the edges of adjacent units is an important factor in the operation of the invention, and thus an element construction that provides points at which the filaments can form anchor points and hinge points will serve. Examples of such shapes cound include a frame having straight sides, or even a frame having scalloped sides, so long as the outer portions of the scallops provided points at which filaments could make top-bottom and plate-to-plate transitions. Straight sides are likewise not an absolute requirement, provided that the sides of adjacent elements form mating surfaces.

These and other modifications will be apparent to those in the art, acting within the spirit of the present invention. The embodiments discussed herein are illustrative and do not limit the scope of the invention, which is defined solely by the claims appended hereto.

We claim:

1. A composite array, comprising:

a plurality of array elements, each said element abutting at least one other said element and including upper and lower generally flat surfaces;

first and second groups of grooves formed in each said surface, members of each said group being mutually parallel, with grooves of said first group intersecting grooves of said second group to enclose angles, grooves formed in one said surface being in overlying registration with grooves on the other said surface;

sides disposed peripherally about and joining said surfaces, each side including side intersection points at which at least two said grooves on each said surface mutually intersect and intersect said side;

paired retaining means looped on said elements within said grooves for retaining said elements within the array, said retaining means forming at least one hinge point comprised of said paired retaining means between each said element and at least one other said element, enabling a selected element to rotate about said hinge point into a position in contact with said other element, further rotation of said element in a selected direction different from the first said rotation causing said hinge point to migrate to different sides of both said elements, thereby changing the sides upon which the two said elements abut.

2. A composite array, comprising:

a plurality of array elements, generally plate-like in form, each said element including upper and lower generally flat surfaces;

first and second groups of grooves formed in each said surface, members of each said group being mutually parallel, and grooves of said first group intersecting grooves of said second group to enclose angles, grooves formed in one said surface being identical to grooves on the other said surface;

sides disposed peripherally about and joining said surfaces, each side including side intersection points at which at least two said grooves on each said surface mutually intersect and intersect said side, said plates being arranged in an array of adjacent said plates, each said plate abutting at least one other said plate, adjoining sides of said abutting plates being aligned; and a plurality of pairs of endless retaining filaments, each pair of filaments having portions thereof within preselected said grooves, the path described by a pair of said filaments including anchor points, at which said pair of filaments passes from an upper surface groove to a lower surface groove on a single said plate, said filament path turning to enter a said groove of the opposite said group of said grooves on the opposite said surface in the course of said passage, and hinge points, each located on a said adjoining side wherein a first plate and a second plate abut, wherein two pairs of filament portions pass from said first plate to said second plate, one said pair of filament portions passing from an upper surface on one said plate to a lower surface of the other said plate and the other said pair of filament portions passing between opposite respective surfaces of each said plate, both said pairs of filament portions describing substantially straight lines with respect to said grooves.

3. The composite array of claim 2, wherein said array elements are identical.

4. The composite array of claim 2, wherein said array elements are quadrilateral.

5. The composite array of claim 2, wherein said array elements are square.

6. The composite array of claim 2, wherein said grooves mutually intersect at substantially 90 degree angles.

7. The composite array of claim 2 or 6 wherein said grooves intersect said sides at substantially 45 degree

8. The composite array of claim 2, wherein said pairs of filaments are interlocked at said hinge points, a filament of each said pair passing between the filaments of the other said pair.

9. The composite array of claim 8 wherein said filaments are a polymer plastic.

10. The composite array of claim 2 or 8, wherein said filaments are carried completely within said grooves.

11. The composite array of claim 2 wherein said sides containing said hinge points contain two said hinge points on each such side.

12. The composite array of claim 2, wherein said pairs of filament portions crossing at a said hinge point are portions of two filaments.

13. The composite array of claim 2, wherein said pairs of filament portions crossing at a said hinge point are portions of four separate filaments.

14. A method for assembling a composite array of plate-like elements, comprising the steps of:

providing a plurality of plate-like elements, each element having first and second groups of grooves formed in each said surface, members of each said group being mutually parallel, and grooves of said first group intersecting grooves of said second group to enclose angles, grooves formed in one said surface being identical to grooves on the other said surface;

arranging said elements in a selected pattern, at least one side of each said element abutting a side of an adjacent element;

looping a plurality of endless filaments in preselected paths around said elements within said grooves, for each element, wrapping a said filament around said element at selected element sides and turning said filament to lead same into a groove on the opposite side of said element, said groove lying at an angle to the groove from which said filament emerges, and at selected other element sides, passing said filament from said element to an abutting element, leading said filament into a groove in said abutting element lying in substantially a straight line with the groove from which said filament emerges and on the side of said abutting element opposite the side of said first element from which said filament emerges.

15. A composite array, comprising:

a plurality of plate-like elements, each said element being generally square and including upper and lower generally flat surfaces;

first and second groups of grooves formed in each said surface, each said group having four mutually parallel grooves, with grooves of said first group intersecting grooves of said second group to enclose angles of about 90 degrees, and grooves formed in one said surface being identical to grooves in the other said surface;

sides, surrounding and joining said surfaces, each side including side intersection points at which at least two said grooves on each said surface mutually intersect at an angle of about 90 degrees and intersect said side at angle of about 45 degrees, said plates being arranged in an array of adjacent said plates, each said plate abutting at least one other said plate, adjoining sides of said abutting plates being aligned; and a plurality of pairs of endless fastening filaments of a synthetic material of circular cross-section, each filament pair having portions thereof lying within preselected said grooves, the path described by a pair of said filaments including anchor points, at which said pair of filaments passes from an upper surface groove to a lower surface groove on a single said plate, said filament path turning to enter a said groove of the opposite said group of said grooves on the opposite said surface in the course of said passage, and hinge points, each located on a said adjoining side wherein a first plate and a second plate abut, wherein two pairs of filament portions pass from said first plate to said second plate, one said pair of filament portions passing from an upper upper surface on one said plate to a lower surface of the other said plate and the other said pair of filament portions passing between opposite respective surfaces of each said plate, both said pair of filament portions describing substantially straight lines with respect to said grooves.

* * * * *